US005466128A

United States Patent [19]

Brown et al.

[11] Patent Number: 5,466,128

[45] Date of Patent: Nov. 14, 1995

[54] HIGH ASPECT RATIO, REMOTE CONTROLLED PUMPING ASSEMBLY

[75] Inventors: Steve B. Brown, Livermore; Fred P. Milanovich, Lafayette, both of Calif.

[73] Assignee: Regents of the University of California, Oakland, Calif.

[21] Appl. No.: 95,297

[22] Filed: Jul. 21, 1993

[51] Int. Cl.[6] ..... F04B 25/00; F01B 9/04

[52] U.S. Cl. ..... 417/254; 92/136; 417/410.1

[58] Field of Search ..... 417/410.3, 410.1, 417/326, 254, 534, 268, 539; 91/361, 362; 92/151, 136

[56] References Cited

U.S. PATENT DOCUMENTS

| | | | |
|---|---|---|---|
| 465,099 | 12/1891 | Rice | 92/151 |
| 1,308,089 | 7/1919 | Mardis et al. | 91/362 |
| 1,549,332 | 8/1925 | Roberts | 92/136 |
| 1,841,629 | 1/1932 | Pigeolet | 91/362 |
| 2,016,727 | 10/1935 | Roth | 92/136 |
| 3,080,852 | 3/1963 | Geyer | 92/136 |
| 3,653,789 | 4/1972 | Maroth | 417/534 |
| 3,824,905 | 7/1974 | Jablonsky | 92/136 |
| 3,990,815 | 11/1976 | De Vial | 417/326 |
| 4,300,641 | 11/1981 | Kinkel | 92/136 |
| 4,790,234 | 12/1988 | Hampejs et al. | 91/362 |

*Primary Examiner*—Richard A. Bertsch
*Assistant Examiner*—Peter G. Korytnyk
*Attorney, Agent, or Firm*—Henry P. Sartorio; L. E. Carnahan

[57] ABSTRACT

A miniature dual syringe-type pump assembly which has a high aspect ratio and which is remotely controlled, for use such as in a small diameter penetrometer cone or well packer used in water contamination applications. The pump assembly may be used to supply and remove a reagent to a water contamination sensor, for example, and includes a motor, gearhead and motor encoder assembly for turning a drive screw for an actuator which provides pushing on one syringe and pulling on the other syringe for injecting new reagent and withdrawing used reagent from an associated sensor.

23 Claims, 3 Drawing Sheets

HIGH ASPECT RATIO, REMOTE CONTROLLED PUMPING ASSEMBLY

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to a miniature pump assembly, particularly to a miniature dual syringe-type pump assembly, and more particularly to a miniature dual syringe-type pump assembly for supplying new and withdrawing used reagent from a reagent sensor, for example.

Ground water contamination by various chemicals, such as trichloroethylene (TCE), carbon tetrachloride, and chloroform, for example, has become a major concern. The potential health problems arising from chronic exposure and/or ingestion of various carcinogenic chlorinated solvents, such as TCE, as a major U.S. health concern. Such compounds have been inadvertently or unknowingly introduced into the environment over many years through commercial, government, and private activities, such as by vehicle or aircraft fueling, and maintenance facilities, dumping of various chemicals, etc. These contaminants over time seep into the underground water supply, thereby resulting in latent health problems. The remediation of this potential problem is a current major focus by federal and state agencies.

One of the major costs of ground water investigations and cleanup is chemical analyses, and substantial effort has recently been directed to developing sensors that will enable researches and remediators the ability to detect, measure, and monitor the presence of various contaminants. Early efforts involved drilling and sampling technologies which resulted in cross contamination of dirty and clean zones and thus the data retrieved was questionable. At the Lawrence Livermore National Laboratory (LLNL), for example, efforts have been directed for many years toward the development of chemical detectors or sensors, and more recently for developing and field testing fiber-optic-based optical sensor systems for quantitative analysis of contaminants, such as TCE, carbon tetrachloride, and chloroform. The objectives of the LLNL program are to: 1) modify existing optical sensor technology for continuous in situ monitoring of specific contaminants, 2) develop viable downhole sensor placement technologies, 3) extend the technology to the measurement of other contaminants, and 4) deliver the technology in a device capable of using in the field.

The optical sensor system is based upon the fact that certain reagents produce a fluorescence or colored products in the presence of small amounts of volatile organic compounds (VOCs). For example, a fluorescence-based probe for chloroform, was developed at LLNL in the mid-1980's, in which the sensor irradiated a reagent with filtered light causing a fluorescence that could then be measured, with the degree of fluorescence being proportional to the concentration of the contaminant. However, this sensor did not have the desired sensitivity or reliability. In the later 1980's a new sensor concept was developed at LLNL based on the absorption of light by the reagent color change.

Based on the reagent color change approach, a chemical contamination measurement system has been developed. See "Fiber Optic Sensor for Continuous Monitoring of Chlorinated Solvents in the Vadose Zone and in Groundwater": Field Test Results, SPIE, Vol. 1587 Chemical, Biochemical, and Environmental Fiber Sensors 111 (1991), pg. 279–282, published Feb. 24, 1992; and UCRL-JC-110528, "Innovative Characterization Techniques and Decision Support Systems For Ground Water Contamination Projects", F. Hoffman, July 1992. The basic components of this measurement system are: 1) a sensor, 2) a pumping system or renewing the chemical reagent in the sensor, which includes a computer controlled pump and six-way valve, and 3) an electro-optical readout device also attached to the computer, including an incandescent lamp, suitable filters and silicon diode detectors, for measuring sensor transmission. The sensor allows consecutive measurements to be taken at short intervals on an on-demand basis, with control and monitoring being executed remotely under software control.

When the sensor of the above-referenced measurement system (SPIE Vol. 1587 and UCRL-JC-110528) is placed in the proximity of the head space of a water stream or in a vapor stream containing the contaminant, the contaminant diffuses through a membrane on the sensor, contacts the reagent therein, and produces a colored product. The sensor includes two optical fibers, one of the fibers carrying the incident light, and the other transmitting the light reflected off the membrane back to the sensor readout. In the case of the contaminant being TCE, two wavelengths of light are of interest: 540-nanometer (nm) light is absorbed by the color change in the reagent; 640 nm light is also examined because the colored products are transparent to that wavelength and provides an internal standard. The ratio of 540 to 640 nm light at the sensor readout device provides a noise-free measure of 540 nm absorption.

When the analysis begins, the computer attached to the control center of the system monitors the rate of change of absorption, which is proportional to the concentration of the contaminant in the sample. The sensor is also equipped with reagent supply or source and reagent waste tubes connected to the pumping system, which is controlled to renew the reagent in the sensor. When the analysis is complete, the computer controls the injection of new reagent into the sensor and evacuates the old, colored reagent.

One of the critical components of the above-referenced measurement system is the pump assembly which enables reagent supply to and removal from the sensor. This requirement is compounded by the small size requirement, such as in a well packer assembly or in a cone penetrometer, which is adapted to be driven into the ground. Small-size precision metering pumps are known in the art are exemplified U.S. Pat. No. 4,752,192 issued Jun. 21, 1988 to B. Ode, and U.S. Pat. No. 4,915,591 issued Apr. 10, 1990 to H. Funke. While these prior known miniaturized pumps provide certain capabilities, a need existed for a pump arrangement capable of being located in a small diameter tube or component and being remotely controlled for simultaneous and consistent supply and removal of a material to and from a chamber, such that there is no intermixing at the new and old material. The present invention satisfies this need by providing a pumping arrangement which utilizes a pair of syringe-type pumps actuated by a control mechanism which provides simultaneous pushing on one syringe and pulling on the other.

SUMMARY OF THE INVENTION

It is an object of the present invention to provide a miniature, high aspect ratio pump.

A further object of the invention is to provide a miniature, remote controlled pump assembly.

A further object of the invention is to provide a pump assembly capable of simultaneously supplying material to and withdrawing material from a point of use.

Another object of the invention is to provide a dual syringe-like pump assembly having an actuator mechanism for controlling the movement of the syringe-like pumping members in opposite directions.

Another object of the invention is to provide a remotely controlled, miniaturized dual pump assembly capable of simultaneously supplying and withdrawing a reagent to and from a sensor of a contamination measurement system.

Another object of the invention is to provide a dual-acting pump assembly of such physical size and shape to fit in a small diameter penetrometer cone or well packer assembly.

Other objects and advantages of the invention will become apparent from the following description and accompanying drawings. The present invention relates to a miniature pump assembly which has a high aspect ratio and which is remotely controlled. The pump assembly is particularly applicable for use with environmental sensors which utilize a reagent which changes color upon contact with a selected chemical compound or element, such as trichloroethylene (TCE). The pump assembly is of such small size and shape so as to fit in a small (1¼ inch) diameter penetrometer cone, and basically includes a pair of syringe-type pump units, motor, gearhead and motor encode assembly for turning a device screw and thereby causing an actuator to travel therealong and hence provide pushing on one of the syringe-type pump units and pulling on another. This action dispenses replenishing reagent to the sensor and takes up waste or used reagent from the sensor simultaneously, via interconnecting tubing, with one syringe-type pump unit being connected to a supply or source of the reagent and the other unit being connected to a waste or used reagent container.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The present invention is a miniature pump having a high aspect ratio and which is remotely controlled. More specifically, the invention comprises a dual syringe-tube pump assembly, controlled such that one syringe is filling while the other syringe is discharging. By this arrangement, material can be pumped into one section of a space or chamber while being simultaneously withdrawn from another section of that space or chamber without intermixing the incoming and outgoing material while maintaining the space or chamber full of the material. The pump assembly additionally includes a motor, gearhead and motor encoder assembly for turning a drive screw and thereby cause an actuator to travel therealong and hence provide pushing on one syringe and pulling on the other syringe. This action dispenses the replenishing material and takes up the used or waste material simultaneously.

The miniature, remotely controlled, dual syringe-type pump assembly of this invention has particular application in penetrometer cones and well packers for contamination testing and monitoring systems, but also has application in other confined space applications for industrial processes and NASA space projects, for example. By way of example, the miniature pump assembly can be used to provide new reagent to and remove used reagent from a trichloroethylene (TCE) or other chemical sensor. The dual syringe-type pump assembly is remotely controlled and actuated by a computer which is operatively connected to the readout system for the fiber-optic sensor to which the pump assembly is connected for dispensing and taking up reagent under computer control.

Figure 1:
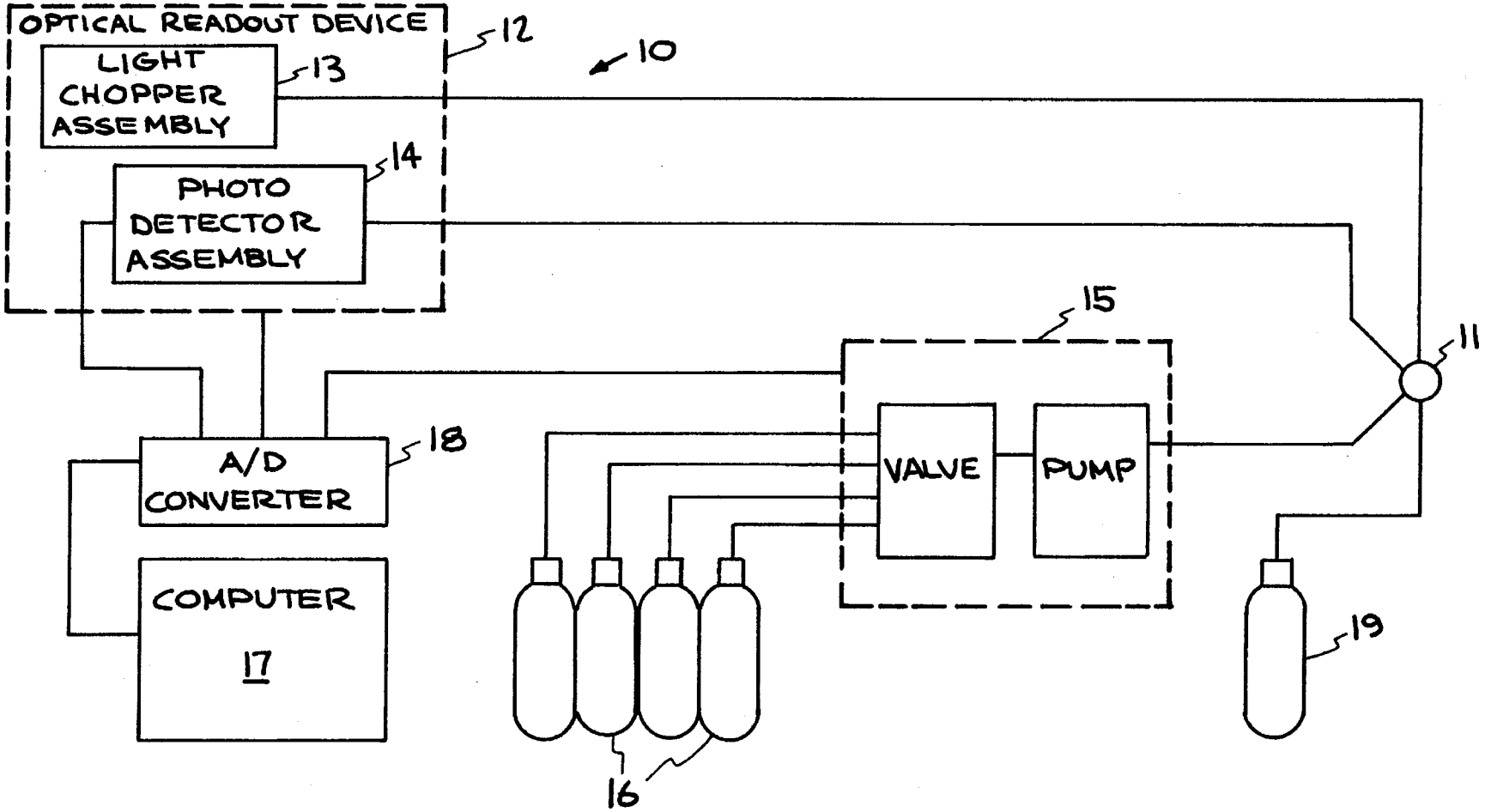
FIG. 1 schematically illustrates a contaminant measuring system incorporating a single syringe-type pump assembly.

Referring now to the drawings, FIG. 1 illustrates a contamination measurement system, generally indicated at 10, of which the basic components comprise a sensor assembly 11; an optical readout device 12, which includes a tungsten-halogen lamp, chopper assembly 13 and a photo detector assembly 14; a computer-controlled syringe pump/valve assembly 15 connected to a plurality of reagent reservoirs 16; a computer 17 connected via an A/D converter 18 to assemblies 14 and 15; and a waste or used reagent reservoir or container 19.

The measurement system of FIG. 1 is set forth to provide an understanding of an overall system to which the dual syringe-type pump assembly of this invention may be connected for use with a TCE or other chemical sensor, for example. Inasmuch as the specific components of the FIG. 1 measurement system do not constitute part of this invention, other than to illustrate a computer and reagent valve control arrangement therefor, a detailed description of the components of the system are not deemed necessary.

Figure 2:
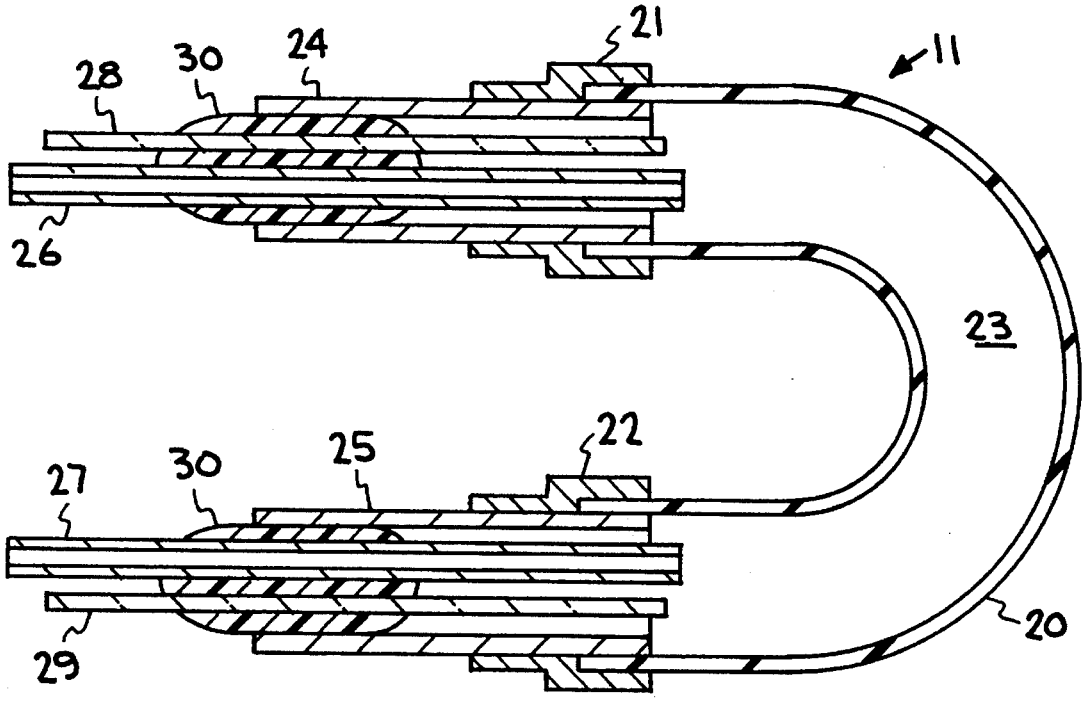
FIG. 2 is an enlarged cross-sectional view of an embodiment of the fiber-optic sensor of the FIG. 1 system to which the pump assembly of the invention is connected for supplying new reagent thereto and withdrawing used reagent therefrom.
Figure 4:
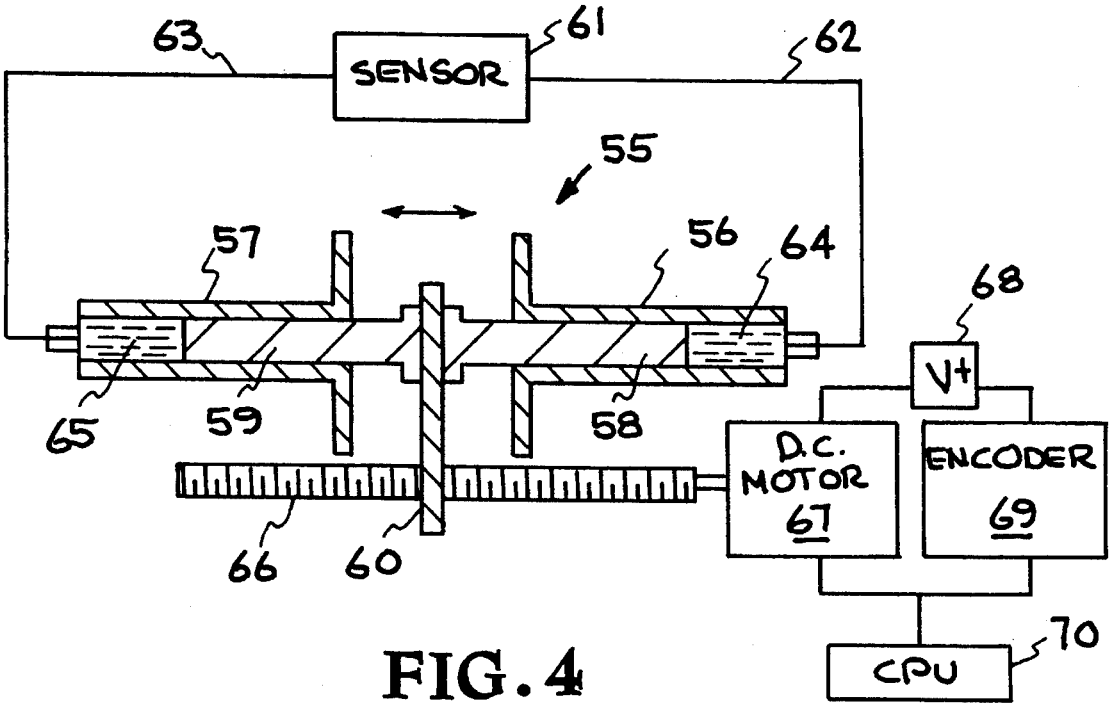
FIG. 4 schematically illustrates another embodiment of the pump assembly connected to an encoder and CPU.
Figure 3:
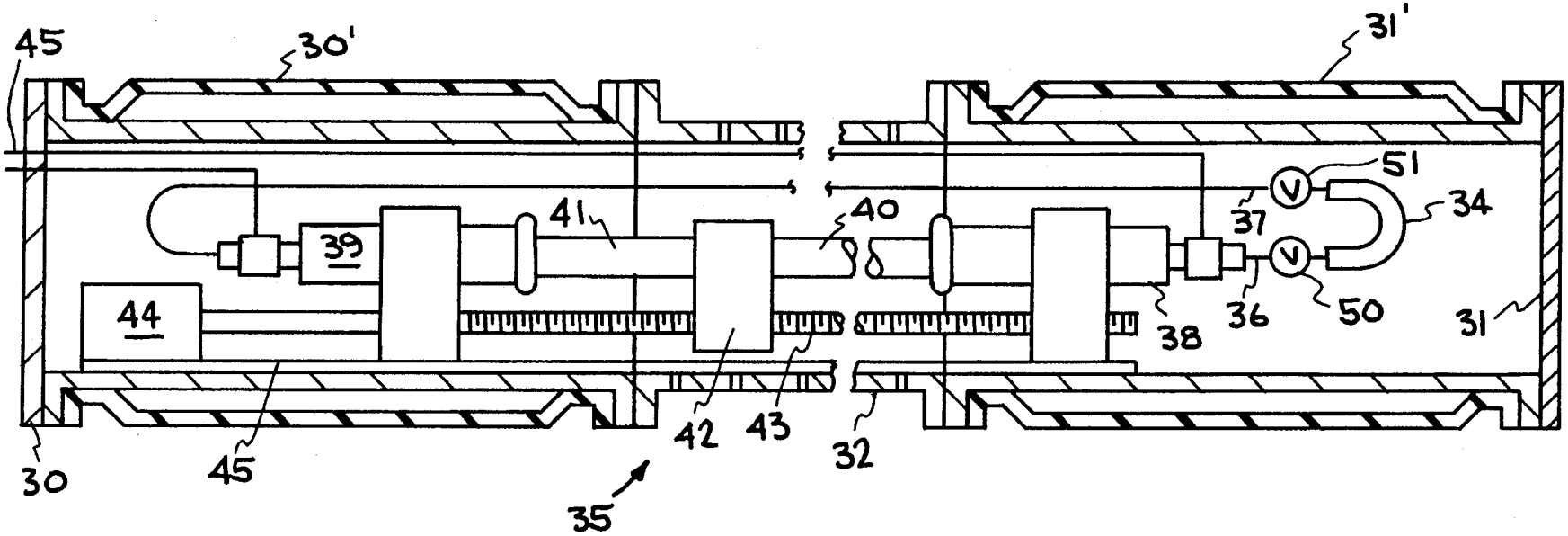
FIG. 3 schematically illustrates an embodiment of a replenishable type pump assembly of the invention connected to the fiber-optic sensor of FIG. 2 and mounted in a well packer assembly.

Chemical analysis of various contaminants, such as TCE, carbon tetrachloride, and chloroform have been made using a contamination measurement system similar to that of FIG. 1 with the sensor 11 thereof being embodied as illustrated in FIG. 2, which is constructed for use with the dual syringe-type pump assembly, as illustrated in FIGS. 3 and 4.

As pointed out above, the chemical basis of this technology is the irreversible development of color in specific reagents upon their exposure to various target molecules. For example, the reagent used to detect TCE is a mixture of 99% pyridine (by volume) and 1% tetrabutylammonium hydroxide (TBAH, 40% aqueous solution by weight). In the presence of the base, TCE reacts with the pyridine and forms a colored product. The reaction only requires very minute amounts of the analyte to proceed, so sensitivity of the sensor is excellent. The reagent is highly stable over time and can be stored and used for several weeks to months. Thus, the sensor, in combination with the pump assembly of this invention, allows consecutive measurements to be taken at short intervals on an on-demand basis, with control and monitoring being executed remotely under software control of the computer, such as illustrated in the FIG. 1 system.

Referring now to FIG. 2, the illustrated embodiment of the fiber-optic sensor assembly generally indicated at 11, basically comprises a U-shaped semi-permeable membrane tube or body 20 having the ends or legs thereof mounted in heat shrink tubing 21 and 22 and containing a reagent 23, a pair of capillary tubes 24 and 25 mounted in the tubing 21 and 22, a reagent fill tube 26 and reagent discharge tube 27 mounted along with optical fibers 28 and 29 in capillary tubes 24 and 25 via an epoxy 30. The reagent fill and discharge tubes 26 and 27 are adapted to be connected via fill and discharge or waste tubing or lines to the dual syringe-type pump assembly, as schematically illustrated in FIGS. 3 and 4. The optical fibers 28 and 29 are connected to the electro-optical read-out device 12 for delivering excitation for determining the absorbency of the reagent 23, and for returning the excitation to appropriate detectors for quantitative measurement, as illustrated in the FIG. 1 system. While not shown, a thermocouple may be placed in the middle of the curved tube or membrane 20 so vapor temperature can be continuously monitored.

Target molecules, TCE for example, diffuse through the semipermeable membrane 20 and react with the reagent 23. In the presence of TCE the reagent 23 produces a colored product that absorbs light, via optical fiber 28, in the green region of the visible spectrum (530–550 nm), and is directed via optical fiber 29 to the electro-optical read-out device 12 of FIG. 1. This absorbence, which is then plotted against time, provides a direct measure of TCE concentration. The results of initial testing of the FIG. 2 fiber-optic sensor assembly are set forth in above-referenced SIP Vol. 1587 and UCRL-JC-110528.

Because the fiber-optic sensor assembly of FIG. 2 operates at maximum sensitivity and speed in head space or in vapor phase analyses, it was initially deployed with the dual syringe-type pump assembly for monitoring of soil vapor in an uncased borehole or a well screened in the unsaturated zone, and mounted in an air-actuated well packer assembly as shown in FIG. 3. As seen in FIG. 3, the well packer assembly consists of two well packers 30 and 31, having bladders 30' and 31', interconnected by a screened tube 32, and within which a sensor assembly 34 and reagent dual syringe-type assembly, generally indicated at 35, are mounted. Fluid passes through the screened tube 32 into well packers 30 and 31. The sensor assembly 34 is of the type illustrated in FIG. 2 to which are attached a reagent replenish or fill line or tube 36 and a reagent disposal or waste line or tube 37, for connection to tubes 26 and 27, respectively of the FIG. 2 sensor. While not shown in FIG. 3, the sensor 34 is provided with optical fibers, such as 28 and 29 in the FIG. 2 embodiment, for connection to an electro-optical read-out device, as in the device 12 of the FIG. 1 system.

The pump assembly 35 includes a pair of syringe-type pump units 38 and 39 mounted back-to-back, each having a movable member such as plunger or piston 40 and 41 connected or linked to an actuator 42 which is mounted on a lead screw drive 43 connected to a reversible motor 44, which is secured within and to well packer 30 by a rod assembly as indicated at 45 which is secured to the wall of well packer 30 by means not shown. While not shown, motor 44 is connected to an electrical power supply and to a computer control system for the pump assembly, as in the FIG. 1 system. Also, the reagent fill pump unit 38 is connected to a reagent reservoir via a line or tube 46, as in the FIG. 1 system, and the reagent waste pump unit 39 is connected to reagent disposal or waste line 37 and via a waste or disposal line 47 to a waste reagent collector or reservoir, not shown, but as in the FIG. 1 system. The pump units 38 and 39 are mounted in the well packers via support members 48 and 49 through which lead screw drive 43 extends. One way check valves 50 and 51 are located in lines 36 and 37 to assure reagent flow in only one direction. In actual operation the check valves 50 and 51 may preferably be located adjacent the pumps 38 and 39, respectively. When activated, the syringe-type pump units 38 and 39 operate together, but in a reverse direction, whereby reagent fill syringe unit 38 injects new reagent into the sensor assembly 34 via line 36, and the reagent waste syringe unit 39 withdraws used reagent from the sensor 34 via line 37, whereby the sensor assembly 34 contains new (unused) reagent. Recharging of the fill syringe unit 38 and discharging of the waste syringe unit 39 is accomplished by reversed movement of the motor 44 and screw drive 43, whereby the pump units 38 and 39 are connected via lines 46 and 47 to reagent supply and disposal reservoirs 16 and 19, see FIG. 1. Check valves 50 and 51 prevent reverse reagent flow to and from the sensor 34 during the refill and discharge operation of the pump units 38 and 39. The bladders 30' and 31' of packers 30 and 31 are inflated and deflated by compressed air, allowing the whole assembly to be lowered and sealed at different depths within the well and vapors enter and leave the well packers via openings in screen tube 32. The light source and detector arrangement (device 12 of FIG. 1) and the system controller (components 17 and 18 of FIG. 1) remain at the surface, attached to the sensor assembly 34 by optical fibers and to the motor 44 by electrical conductors.

The fiber-optic sensor assembly and the dual syringe-type pump assembly may be mounted inside a cone penetrometer instead of in the well packers of FIG. 3. A cone penetrometer is a truck-mounted instrument that drives a steel rod into soft sediments using the weight of the truck as a driver. At appropriate depths in the unsaturated zone, analysis of contaminant concentration in soil vapors can be obtained. Use of the cone penetrometer for chemical contaminant analysis is the most cost effective way to implant the sensor assembly because the sensor is merely pressed into the ground, negating the need for a significantly more expensive monitoring well. The penetrometer cones, however, are typically one to two inches in diameter and thus place severe size constraints on the enclosed sensor and reagent pump assemblies. To mitigate this problem, we have designed, constructed, and tested a high aspect ratio, small diameter pumping system for the purpose of providing a reagent to a TCE sensor, or similar reagent, utilizing sensors and of a physical size and shape to fit in a small diameter penetrometer cone. Such a measurement system is illustrated and described in above-referenced UCRL-JC-110528.

FIG. 4 schematically illustrates an embodiment of the invention which does not have the refill capability of the FIG. 3 embodiment. In this embodiment, when the fresh reagent is discharged from the sensor fill pump unit via periodic movement of the computer controlled actuator, the pump assembly must be removed and the fill pump unit recharged with fresh reagent and the spent or used reagent pump unit discharged or emptied, whereafter the pump assembly is repositioned and reconnected to the sensor.

As seen in FIG. 4, a pump assembly, generally indicated at 55, is composed of a pair of pump units 56 and 57 having movable members, such as plungers 58 and 59, respectively, connected to an actuator 60. The pump units 56 and 57 are connected to a sensor assembly 61 by a fill tube 62 and drain tube 63 for supplying fresh reagent, indicated at 64, to sensor assembly 61 and for receiving spent reagent, indicated at 65, from sensor assembly 61. The actuator 60 is connected to a drive screw 66 which is connected to the driver by a DC motor 67. The DC motor 67 is connected via a power supply 68 to an encoder 69, with motor 67 and encoder 69 being connected to a computer or CPU 70, as indicated.

In operation, the actuator 60 is moved via drive screw 66 by motor 67 upon signals from the CPU 70 to direct fresh reagent 64 to sensor assembly 61 and receiving spent reagent 65 therefrom via pump units 56 and 57.

Because chemical analysis of water samples below the water table are also of critical importance, a submersible system has been designed that will be deployed in screened wells below the water table. This system includes a probe that will extract a sample from the ground water and move it to a location within the downwell sampler where a headspace can be created at the fiber-optic sensor. Such a system can be moved up and down within a screened well, providing ground water analyses at part-per-billion levels.

It has thus been shown that the present invention provides a high aspect ratio pump assembly which can be remotely controlled and constructed of a sufficiently small size to enable it to be located with an assembly having a one to two inch diameter. The dual syringe-type pump assembly of this invention is particularly applicable for use with a fiber-optic sensor for chemical contaminants, wherein a change of reagent in the sensor is required for each test taken without removal of the sensor.

While particular embodiments of the invention have been illustrated and/or described to set forth the principles of the invention, such is not intended to limit the invention to that specifically described or illustrated. Modifications and changes will become apparent to those skilled in the art, and it is intended that the invention be limited only by the scope of the appended claims.

We claim:

1. A pump assembly comprising:

a pair of pump units mounted in a back-to-back relation;

each of said pump units including a movable member connected to an actuator;

means operatively connected to said actuator for simultaneously moving said movable members in opposite directions; and means for supplying material to be pumped to said pair of pump units;

whereby a first of said pair of pump units is filling while a second of said pair of pump units is discharging;

said means for supplying material including a sensor containing said material; and each of said pair of pump units being operatively connected with said sensor for directing material into and withdrawing material from said sensor.

2. The pump assembly of claim 1, wherein said pair of pump units are each of a syringe-type, each having a housing within which said reciprocating member is positioned.

3. The pump assembly of claim 1, wherein said sensor is constructed to detect chemical contaminants, and wherein said material is a reagent which changes color upon contact with a selected chemical contaminant.

4. The pump assembly of claim 1, wherein said sensor is of a U-shaped configuration, wherein one of said pair of pump units is connected to a first leg of said U-shaped sensor, wherein another of said pair of pump units is connected to a second leg of said U-shaped sensor, and wherein material entering and leaving the U-shaped sensor is not intermixed.

5. A pump assembly, comprising:

a pair of pump units mounted in a back-to-back relation;

each of said pump units including a movable member connected to an actuator; and means operatively connected to said actuator for simultaneously moving said movable members in opposite directions;

whereby a first of said pair of pump units is filling while a second of said pair of pump units is discharging;

said means for simultaneously moving said reciprocating members including a drive screw operatively connected to said actuator, and a reversible-type motor for reversibly moving said drive screw.

6. The pump assembly of claim 5, additionally including a housing in which said pair of pump units and said means are secured.

7. The pump assembly of claim 6, wherein said housing comprises at least one well packer, and is provided with inflatable means for changing an external diameter thereof.

8. The pump assembly of claim 6, additionally including remotely located means for controlling said movement of said reciprocating members.

9. The pump assembly of claim 6, additionally including a means for supplying material to be pumped to said pair of pump units.

10. The pump assembly of claim 9, wherein said means for supplying material to one of said pair of pump units includes a computer and a valving arrangement operative connected to said computer, to said one of said pump units, and to reservoir means containing material to be pumped.

11. The pump assembly of claim 10, wherein said means for supplying material includes a sensor containing said material, and wherein each of said pair of pump units is operatively connected with said sensor, for directing material into and withdrawing material from said sensor.

12. The pump assembly of claim 11, wherein said sensor is constructed for detecting selected chemical contaminants, and wherein said material is a reagent which changes characteristics upon contact with a selected chemical contaminant.

13. A dual syringe-type pump assembly, comprising:

a pair of syringe-type pump units;

said pump units each including a housing and a movable plunger positioned in said housing, said housing including a material intake/output opening in one end thereof, said movable plunger extending from said housing at an opposite end thereof;

said pair of pump units being mounted in a back-to-back arrangement, with said movable plungers of each of said pump units being interconnected;

means operatively connected to said movable plungers for moving same in opposite directions with respect to the associated housing thereof;

whereby movement of said plunger in a first of said housings is toward said intake/output opening and movement of said plunger in a second of said housings is away from said intake/output opening, such that a first of said pump units is in its intake stroke while a second of said pump units is in its output stroke; and a sensor assembly containing a material to be pumped by said pump units, said one of said pump units being connected to said sensor assembly for supplying material thereto, and another of said pump units being connected to said sensor assembly for withdrawing material therefrom.

14. The pump assembly of claim 13, wherein said sensor assembly is constructed for detecting selected chemical contaminants, and wherein said material is a reagent which changes characteristics upon contact with a selected chemical contaminant.

15. The pump assembly of claim 13 wherein said sensor assembly is constructed to detect chemical contaminants, and wherein said material is a reagent which changes color upon contact with a selected chemical contaminant.

16. The pump assembly of claim 13, wherein said sensor assembly is of a U-shaped configuration, and wherein material is pumped into said sensor assembly and withdrawn therefrom without intermixing thereof.

17. A dual syringe-type pump assembly, comprising:

a pair of syringe-type pump units;

said pump units each including a housing and a movable plunger positioned in said housing, said housing including a material intake/output opening in one end thereof, said movable plunger extending from said housing at an opposite end thereof;

said pair of pump units being mounted in a back-to-back arrangement, with said movable plungers of each of said pump units being interconnected;

means operatively connected to said movable plungers for moving same in opposite directions with respect to the associated housing thereof;

whereby movement of said plunger in a first of said housings is toward said intake/output opening and movement of said plunger in a second of said housings is away from said intake/output opening, such that a first of said pump units is in its intake stroke while a second of said pump units is in its output stroke; and said means for moving said movable plungers including:

an actuator operatively connected to said movable plungers;

a drive screw mechanism operatively connected to said actuator; and means for reversibly driving said drive screw mechanism.

18. The pump assembly of claim 17, wherein said means for reversibly driving said drive screw mechanism includes a motor, a gearhead, and a motor encoder assembly, said gearhead being connected between said motor and said drive screw, and said motor encode being operatively connected between said motor and a means for controlling said motor.

19. The pump assembly of claim 18, wherein said means for controlling said motor includes a computer.

20. The pump assembly of claim 19, additionally including a valve assembly operatively connected to said intake/output opening in said housing of at least one of said pump units, and operatively connected to said computer and to a reservoir arrangement containing at least one material to be pumped by said pump units.

21. The pump assembly of claim 20, additionally including a sensor assembly containing a material to be pumped by said pump units, said one of said pump units being connected to said sensor assembly for supplying material thereto, and another of said pump units being connected to said sensor assembly for withdrawing material therefrom.

22. The pump assembly of claim 21, wherein said sensor assembly is of a U-shaped configuration, and wherein said one of said pump units is connected to a first leg of said U-shaped sensor assembly, and wherein said another of said pump units is connected to a second leg of said U-shaped sensor assembly, wherein material is pumped into said sensor assembly and withdrawn therefrom without intermixing of the material entering and leaving the sensor assembly.

23. The pump assembly of claim 22, wherein said sensor assembly is constructed to detect chemical contaminants, and wherein said material is a reagent which changes color upon contact with a selected chemical contaminant.

* * * * *